US007165634B2

(12) United States Patent
Vail, III

(10) Patent No.: US 7,165,634 B2
(45) Date of Patent: Jan. 23, 2007

(54) METHOD AND APPARATUS FOR CEMENTING DRILL STRINGS IN PLACE FOR ONE PASS DRILLING AND COMPLETION OF OIL AND GAS WELLS

(75) Inventor: William Banning Vail, III, Bothell, WA (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/678,738

(22) Filed: Oct. 2, 2003

(65) Prior Publication Data

US 2004/0124015 A1 Jul. 1, 2004

Related U.S. Application Data

(63) Continuation of application No. 10/162,302, filed on Jun. 4, 2002, which is a continuation-in-part of application No. 09/487,197, filed on Jan. 19, 2000, now Pat. No. 6,397,946, which is a continuation-in-part of application No. 09/295,808, filed on Apr. 20, 1999, now Pat. No. 6,263,987, which is a continuation-in-part of application No. 08/708,396, filed on Sep. 3, 1996, now Pat. No. 5,894,897, which is a continuation-in-part of application No. 08/323,152, filed on Oct. 14, 1994, now Pat. No. 5,551,521, application No. 10/162,302, filed on Jun. 4, 2002.

(60) Provisional application No. 60/353,457, filed on Jan. 31, 2002, provisional application No. 60/367,638, filed on Mar. 26, 2002, provisional application No. 60/384,964, filed on Jun. 3, 2002, provisional application No. 60/313,654, filed on Aug. 19, 2001.

(51) Int. Cl.
*E21B 7/20* (2006.01)
*E21B 27/00* (2006.01)

(52) U.S. Cl. ..... 175/318; 166/285

(58) Field of Classification Search ..... 175/107, 175/402, 317, 318; 166/290, 285, 295
See application file for complete search history.

(56) References Cited

U.S. PATENT DOCUMENTS

| | | | | |
|---|---|---|---|---|
| 122,514 | A | 1/1872 | Bullock | |
| 1,077,772 | A | 11/1913 | Weathersby | |
| 1,185,582 | A | 5/1916 | Bignell | |
| 1,301,285 | A | 4/1919 | Leonard | |
| 1,342,424 | A | 6/1920 | Cotten | |
| 1,418,766 | A | 6/1922 | Wilson | |
| 1,471,526 | A | 10/1923 | Pickin | |
| 1,585,069 | A | 5/1926 | Youle | |
| 1,728,136 | A | 9/1929 | Power | |
| 1,777,592 | A | 10/1930 | Thomas | |
| 1,825,026 | A | 9/1931 | Thomas | |
| 1,830,625 | A | 11/1931 | Schrock | |
| 1,842,638 | A | 1/1932 | Wigle | |
| 1,880,218 | A | 10/1932 | Simmons | |
| 1,917,135 | A | 7/1933 | Littell | |
| 1,981,525 | A | 11/1934 | Price | |
| 1,998,833 | A | 4/1935 | Crowell | |
| 2,017,451 | A | 10/1935 | Wickersham | |
| 2,049,450 | A | 8/1936 | Johnson | |
| 2,060,352 | A | 11/1936 | Stokes | |
| 2,105,885 | A | 1/1938 | Hinderliter | |
| 2,167,338 | A | 7/1939 | Murcell | |
| 2,214,429 | A | 9/1940 | Miller | 166/16 |
| 2,216,895 | A | 10/1940 | Stokes | |
| 2,228,503 | A | 1/1941 | Boyd et al. | |
| 2,295,803 | A | 9/1942 | O'Leary | |
| 2,305,062 | A | 12/1942 | Church et al. | |
| 2,324,679 | A | 7/1943 | Cox | |
| 2,370,832 | A | 3/1945 | Baker | |
| 2,379,800 | A | 7/1945 | Hare | |
| 2,414,719 | A | 1/1947 | Cloud | |
| 2,499,630 | A | 3/1950 | Clark | |
| 2,522,444 | A | 9/1950 | Grable | 166/16 |
| 2,536,458 | A | 1/1951 | Munsinger | |
| 2,610,690 | A | 9/1952 | Beatty | 166/16 |
| 2,621,742 | A | 12/1952 | Brown | 166/1 |
| 2,627,891 | A | 2/1953 | Clark | |
| 2,641,444 | A | 6/1953 | Moon | |
| 2,650,314 | A | 8/1953 | Hennigh et al. | 310/67 |
| 2,663,073 | A | 12/1953 | Bieber et al. | |

2,668,689 A 2/1954 Cormany ..... 255/35
2,692,059 A 10/1954 Bolling, Jr. ..... 214/2.5
2,720,267 A 10/1955 Brown
2,738,011 A 3/1956 Mabry ..... 166/144
2,741,907 A 4/1956 Genender et al.
2,743,087 A 4/1956 Layne et al.
2,743,495 A 5/1956 Eklund ..... 22/202
2,764,329 A 9/1956 Hampton
2,765,146 A 10/1956 Williams
2,805,043 A 9/1957 Williams
2,953,406 A 9/1960 Young
2,978,047 A 4/1961 DeVann
3,006,415 A 10/1961 Burns et al.
3,036,530 A 5/1962 Mills et al. ..... 104/155
3,041,901 A 7/1962 Knights
3,054,100 A 9/1962 Jones
3,087,546 A 4/1963 Wooley
3,090,031 A 5/1963 Lord
3,102,599 A 9/1963 Hillburn
3,111,179 A 11/1963 Albers et al.
3,117,636 A 1/1964 Wilcox et al.
3,122,811 A 3/1964 Gilreath ..... 24/263
3,123,160 A 3/1964 Kammerer ..... 175/82
3,124,023 A 3/1964 Marquis et al.
3,131,769 A 5/1964 Rochemont
3,159,219 A 12/1964 Scott ..... 166/156
3,169,592 A 2/1965 Kammerer
3,191,677 A 6/1965 Kinley
3,191,680 A 6/1965 Vincent
3,193,116 A 7/1965 Kenneday et al.
3,353,599 A 11/1967 Swift
3,380,528 A 4/1968 Timmons ..... 166/14
3,387,893 A 6/1968 Hoever
3,392,609 A 7/1968 Bartos ..... 81/57
3,419,079 A 12/1968 Current
3,477,527 A 11/1969 Koot
3,489,220 A 1/1970 Kinley
3,548,936 A 12/1970 Kilgore et al.
3,550,684 A 12/1970 Cubberly, Jr. ..... 166/250
3,552,507 A * 1/1971 Brown ..... 175/258
3,552,508 A 1/1971 Brown
3,552,509 A 1/1971 Brown ..... 175/258
3,552,510 A 1/1971 Brown ..... 175/261
3,552,848 A 1/1971 Van Wagner
3,559,739 A 2/1971 Hutchison ..... 166/311
3,566,505 A 3/1971 Martin
3,570,598 A 3/1971 Johnson ..... 166/178
3,575,245 A 4/1971 Cordary et al.
3,602,302 A 8/1971 Kluth
3,603,411 A 9/1971 Link
3,603,412 A 9/1971 Kammerer, Jr. et al. .... 175/260
3,603,413 A 9/1971 Grill et al. ..... 175/261
3,606,664 A 9/1971 Weiner
3,624,760 A 11/1971 Bodine
3,635,105 A 1/1972 Dickmann et al.
3,656,564 A 4/1972 Brown ..... 175/228
3,662,842 A 5/1972 Bromell
3,669,190 A 6/1972 Sizer et al.
3,680,412 A 8/1972 Mayer et al.
3,691,624 A 9/1972 Kinley
3,691,825 A 9/1972 Dyer
3,692,126 A 9/1972 Rushing et al. ..... 175/259
3,696,332 A 10/1972 Dickson, Jr. et al.
3,700,048 A 10/1972 Desmoulins
3,729,057 A 4/1973 Werner ..... 175/262
3,746,330 A 7/1973 Tacluk
3,747,675 A 7/1973 Brown ..... 166/237
3,760,894 A 9/1973 Pitifer
3,776,320 A 12/1973 Brown
3,776,991 A 12/1973 Marcus
3,785,193 A 1/1974 Kinley et al.
3,808,916 A 5/1974 Porter et al. ..... 81/57.19
3,827,512 A 8/1974 Edmond
3,838,613 A 10/1974 Wilms ..... 81/57.34
3,840,128 A 10/1974 Swoboda, Jr. et al. ..... 214/1
3,848,684 A 11/1974 West
3,857,450 A 12/1974 Guier
3,870,114 A 3/1975 Pulk et al. ..... 175/258
3,881,375 A 5/1975 Kelly ..... 81/57.35
3,885,679 A 5/1975 Swoboda, Jr. et al. ..... 214/1
3,888,319 A 6/1975 Boume, Jr. et al.
3,890,905 A 6/1975 Clavin
3,901,331 A 8/1975 Djurovic
3,913,687 A 10/1975 Gyongyosi et al.
3,915,244 A 10/1975 Brown
3,933,108 A 1/1976 Baugh ..... 144/0.5
3,934,660 A 1/1976 Nelson
3,945,444 A * 3/1976 Knudson ..... 175/92
3,947,009 A 3/1976 Nelmark
3,964,556 A 6/1976 Gearhart et al. ..... 175/45
3,969,950 A 7/1976 Rau et al.
3,980,143 A 9/1976 Swartz et al. ..... 173/100
4,006,777 A 2/1977 LaBauve ..... 166/250
4,009,561 A 3/1977 Young ..... 57/6
4,031,750 A 6/1977 Youmans et al.
4,049,066 A 9/1977 Richey ..... 175/323
4,054,332 A 10/1977 Bryan, Jr.
4,054,426 A 10/1977 White ..... 51/309
4,063,602 A 12/1977 Howell et al. ..... 175/7
4,064,939 A 12/1977 Marquis ..... 166/253
4,071,086 A 1/1978 Bennett
4,077,525 A 3/1978 Callegari et al. ..... 214/2.5
4,082,144 A 4/1978 Marquis ..... 166/250
4,083,405 A 4/1978 Shirley
4,085,808 A 4/1978 Kling
4,095,865 A 6/1978 Denison et al.
4,100,968 A 7/1978 Delano ..... 166/315
4,100,981 A 7/1978 Chaffin
4,113,236 A 9/1978 Neinast ..... 254/134.5
4,116,274 A 9/1978 Rankin et al. ..... 166/250
4,127,927 A 12/1978 Hauk et al.
4,133,396 A 1/1979 Tschirky ..... 175/57
4,142,739 A 3/1979 Billingsley ..... 285/18
4,144,396 A 3/1979 Okano et al. ..... 560/246
4,173,457 A 11/1979 Smith ..... 51/309
4,175,619 A 11/1979 Davis ..... 166/291
4,186,628 A 2/1980 Bonnice
4,189,185 A 2/1980 Kammerer, Jr. et al.
4,192,380 A 3/1980 Smith
4,194,383 A 3/1980 Huzyak
4,221,269 A 9/1980 Hudson
4,227,197 A 10/1980 Nimmo et al.
4,241,878 A 12/1980 Underwood
4,243,099 A 1/1981 Rodgers, Jr.
4,256,146 A 3/1981 Genini et al. ..... 138/111
4,257,442 A 3/1981 Claycomb ..... 137/238
4,262,693 A 4/1981 Giebeler ..... 137/494
4,274,777 A 6/1981 Scaggs ..... 414/22
4,274,778 A 6/1981 Putnam et al.
4,277,197 A 7/1981 Bingham
4,280,380 A 7/1981 Eshghy
4,281,722 A 8/1981 Tucker et al. ..... 175/57
4,287,949 A 9/1981 Lindsey, Jr. ..... 166/212
4,291,772 A 9/1981 Beynet ..... 175/5
4,311,195 A 1/1982 Mullins, II
4,315,553 A 2/1982 Stallings ..... 175/207
4,320,915 A 3/1982 Abbott et al. ..... 294/96
4,336,415 A 6/1982 Walling ..... 174/47
4,384,627 A 5/1983 Ramirez-Jauregui ..... 175/260
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal ..... 175/258
4,413,682 A 11/1983 Callihan et al. ..... 166/382
4,427,063 A 1/1984 Skinner 4,430,892 A 2/1984 Owings ..... 73/151
4,437,363 A 3/1984 Haynes
4,440,220 A 4/1984 McArthur ..... 166/85
4,445,734 A 5/1984 Cunningham
4,446,745 A 5/1984 Stone et al.
4,449,596 A 5/1984 Boyadjieff
4,460,053 A 7/1984 Jurgens et al. ..... 175/329
4,463,814 A 8/1984 Horstmeyer et al.
4,466,498 A 8/1984 Bardwell
4,470,470 A 9/1984 Takano ..... 175/260
4,472,002 A 9/1984 Beney et al. ..... 308/3.9
4,474,243 A 10/1984 Gaines ..... 166/362
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates
4,515,045 A 5/1985 Gnatchenko et al.
4,529,045 A 7/1985 Boyadjieff et al.
4,534,426 A 8/1985 Hooper ..... 175/65
4,544,041 A 10/1985 Rinaldi ..... 175/57
4,545,443 A 10/1985 Wiredal ..... 175/258
4,570,706 A 2/1986 Pugnet
4,570,709 A 2/1986 Wittrisch
4,580,631 A 4/1986 Baugh ..... 166/208
4,583,603 A 4/1986 Dorleans et al. ..... 175/324
4,589,495 A 5/1986 Langer et al. ..... 166/383
4,592,125 A 6/1986 Skene
4,593,773 A 6/1986 Skeie
4,595,058 A 6/1986 Nations
4,604,724 A 8/1986 Shaginian et al. ..... 364/478
4,604,818 A 8/1986 Inoue
4,605,077 A 8/1986 Boyadjieff ..... 175/85
4,605,268 A 8/1986 Meador
4,620,600 A 11/1986 Persson
4,624,306 A 11/1986 Traver et al.
4,625,796 A 12/1986 Boyadjieff
4,630,691 A 12/1986 Hooper ..... 175/65
4,643,377 A 2/1987 Christianson
4,646,827 A 3/1987 Cobb
4,649,777 A 3/1987 Buck
4,651,837 A 3/1987 Mayfield
4,652,195 A 3/1987 McArthur ..... 414/22
4,655,286 A 4/1987 Wood ..... 166/285
4,667,752 A 5/1987 Berry et al.
4,671,358 A 6/1987 Lindsey, Jr. et al. ..... 166/291
4,676,310 A 6/1987 Scherbatskoy et al. .... 166/65.1
4,676,312 A 6/1987 Mosing et al.
4,678,031 A 7/1987 Blandford et al.
4,681,158 A 7/1987 Pennison
4,681,162 A 7/1987 Boyd
4,683,962 A 8/1987 True
4,686,653 A 8/1987 Staron et al.
4,686,873 A 8/1987 Lang et al. ..... 81/57.35
4,691,587 A 9/1987 Farrand et al.
4,693,316 A 9/1987 Ringgenberg et al.
4,699,224 A 10/1987 Burton
4,709,599 A 12/1987 Buck
4,709,766 A 12/1987 Boyadjieff
4,725,179 A 2/1988 Woolslayer et al. ..... 414/22
4,735,270 A 4/1988 Fenyvesi ..... 175/113
4,738,145 A 4/1988 Vincent et al.
4,742,876 A 5/1988 Barthelemy et al.
4,744,426 A 5/1988 Reed
4,759,239 A 7/1988 Hamilton et al.
4,760,882 A 8/1988 Novak ..... 166/295
4,762,187 A 8/1988 Haney ..... 175/71
4,765,401 A 8/1988 Boyadjieff
4,765,416 A 8/1988 Bjerking et al.
4,773,689 A 9/1988 Wolters
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov
4,793,422 A 12/1988 Krasnov
4,800,968 A 1/1989 Shaw et al.
4,806,928 A 2/1989 Veneruso
4,813,493 A 3/1989 Shaw et al.
4,813,495 A 3/1989 Leach ..... 175/6
4,821,814 A 4/1989 Willis et al.
4,825,947 A 5/1989 Mikolajczyk
4,832,552 A 5/1989 Skelly ..... 414/22.54
4,836,064 A 6/1989 Slator
4,836,299 A 6/1989 Bodine
4,840,128 A 6/1989 McFarlane et al. ..... 108/50
4,842,081 A 6/1989 Parant ..... 175/23
4,843,945 A 7/1989 Dinsdale ..... 81/57.34
4,848,469 A 7/1989 Baugh et al.
4,854,386 A 8/1989 Baker et al. ..... 166/289
4,867,236 A 9/1989 Haney et al.
4,878,546 A 11/1989 Shaw et al.
4,880,058 A 11/1989 Lindsey et al. ..... 166/289
4,883,125 A 11/1989 Wilson et al.
4,901,069 A 2/1990 Veneruso
4,904,119 A 2/1990 Legendre et al.
4,909,741 A 3/1990 Schasteen et al. ..... 439/13
4,915,181 A 4/1990 Labrosse
4,921,386 A 5/1990 McArthur ..... 414/22.51
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,997,042 A 3/1991 Jordan et al. ..... 166/379
5,009,265 A 4/1991 Bailey et al.
5,018,451 A 5/1991 Hapstack
5,022,472 A 6/1991 Bailey et al. ..... 175/195
5,027,914 A 7/1991 Wilson ..... 175/406
5,036,927 A 8/1991 Willis
5,040,619 A 8/1991 Jordan et al.
5,049,020 A 9/1991 McArthur ..... 414/22.51
5,052,483 A 10/1991 Hudson
5,060,542 A 10/1991 Hauk ..... 81/57.34
5,060,737 A 10/1991 Mohn ..... 175/104
5,062,756 A 11/1991 McArthur et al.
5,069,297 A 12/1991 Krueger
5,074,366 A 12/1991 Karlsson et al. ..... 175/76
5,082,069 A 1/1992 Seiler et al. ..... 175/5
5,085,273 A 2/1992 Coone
5,096,465 A 3/1992 Chen et al. ..... 51/295
5,109,924 A 5/1992 Jurgens et al.
5,111,893 A 5/1992 Kvello-Aune ..... 175/258
5,121,694 A 6/1992 Zollinger
5,141,063 A 8/1992 Quesenbury
RE34,063 E 9/1992 Vincent et al.
5,148,875 A 9/1992 Karlsson et al. ..... 175/62
5,156,213 A 10/1992 George et al. ..... 166/297
5,160,925 A 11/1992 Dailey et al. ..... 340/853.3
5,168,942 A 12/1992 Wydrinski ..... 175/50
5,172,765 A 12/1992 Sas-Jaworsky ..... 166/384
5,176,180 A 1/1993 Williams et al. ..... 138/172
5,176,518 A 1/1993 Hordijk et al.
5,181,571 A 1/1993 Mueller et al.
5,184,676 A 2/1993 Graham et al.
5,186,265 A 2/1993 Henson et al. ..... 175/107
5,191,932 A 3/1993 Seefried et al.
5,191,939 A 3/1993 Stokley ..... 166/379
5,197,553 A 3/1993 Leturno
5,209,302 A 5/1993 Robichaux et al. ..... 166/355
5,209,304 A 5/1993 Nice
5,224,540 A 7/1993 Streich et al.
5,233,742 A 8/1993 Gray et al.
5,234,052 A 8/1993 Coone et al. ..... 166/155
5,245,265 A 9/1993 Clay
5,251,709 A 10/1993 Richardson 5,255,741 A 10/1993 Alexander ..... 166/278
5,255,751 A 10/1993 Stogner ..... 175/203
5,271,468 A 12/1993 Streich et al.
5,271,472 A 12/1993 Leturno ..... 175/107
5,282,653 A 2/1994 LaFleur et al. ..... 285/110
5,285,008 A 2/1994 Sas-Jaworsky et al. ..... 174/47
5,285,204 A 2/1994 Sas-Jaworsky ..... 340/854.9
5,291,956 A 3/1994 Mueller et al. ..... 175/67
5,294,228 A 3/1994 Willis et al. ..... 414/22.55
5,297,833 A 3/1994 Willis et al. ..... 294/102.2
5,305,830 A 4/1994 Wittrisch ..... 166/250
5,305,839 A 4/1994 Kalsi et al.
5,318,122 A 6/1994 Murray et al.
5,320,178 A 6/1994 Cornette ..... 175/19
5,322,127 A 6/1994 McNair et al.
5,323,858 A 6/1994 Jones et al. ..... 166/291
5,332,043 A 7/1994 Ferguson
5,332,048 A 7/1994 Underwood et al.
5,339,899 A 8/1994 Ravi et al. ..... 166/250
5,343,950 A 9/1994 Hale et al.
5,343,951 A 9/1994 Cowan et al.
5,348,095 A 9/1994 Worrall et al.
5,351,767 A 10/1994 Stogner et al.
5,353,872 A 10/1994 Wittrisch ..... 166/250
5,354,150 A 10/1994 Canales ..... 405/154
5,355,967 A 10/1994 Mueller et al. ..... 175/65
5,361,859 A 11/1994 Tibbitts
5,368,113 A 11/1994 Schulze-Beckinghausen ..... 175/162
5,375,668 A 12/1994 Hallundbaek
5,379,835 A 1/1995 Streich ..... 166/181
5,386,746 A 2/1995 Hauk ..... 81/57.34
5,388,651 A 2/1995 Berry
5,392,715 A 2/1995 Pelrine ..... 104/138.2
5,394,823 A 3/1995 Lenze
5,398,760 A 3/1995 George et al. ..... 166/297
5,402,856 A 4/1995 Warren et al.
5,412,568 A 5/1995 Schultz ..... 364/422
5,433,279 A 7/1995 Tassari et al.
5,435,400 A 7/1995 Smith
5,452,923 A 9/1995 Smith ..... 285/145
5,456,317 A 10/1995 Hood, III et al.
5,458,209 A 10/1995 Hayes et al.
5,472,057 A 12/1995 Winfree ..... 175/57
5,477,925 A 12/1995 Trahan et al.
5,494,122 A 2/1996 Larsen et al.
5,497,840 A 3/1996 Hudson ..... 175/72
5,501,286 A 3/1996 Berry
5,503,234 A 4/1996 Clanton
5,520,255 A 5/1996 Barr et al.
5,526,880 A 6/1996 Jordan, Jr. et al.
5,535,824 A 7/1996 Hudson ..... 166/207
5,535,838 A 7/1996 Keshavan et al. ..... 175/374
5,540,279 A 7/1996 Branch et al.
5,542,472 A 8/1996 Pringle et al.
5,542,473 A 8/1996 Pringle et al.
5,547,029 A 8/1996 Rubbo et al. ..... 166/375
5,547,314 A 8/1996 Ames
5,551,521 A 9/1996 Vail, III ..... 175/65
5,553,672 A 9/1996 Smith, Jr. et al.
5,553,679 A 9/1996 Thorp
5,560,437 A 10/1996 Dickel et al. ..... 175/40
5,560,440 A 10/1996 Tibbitts
5,575,344 A 11/1996 Wireman
5,577,566 A 11/1996 Albright et al.
5,582,259 A 12/1996 Barr ..... 175/73
5,584,343 A 12/1996 Coone ..... 166/387
5,613,567 A 3/1997 Hudson
5,615,747 A 4/1997 Vail, III
5,645,131 A 7/1997 Trevisani
5,651,420 A 7/1997 Tibbitts et al. ..... 175/102
5,661,888 A 9/1997 Hanslik ..... 29/407.02
5,662,170 A 9/1997 Donovan et al. ..... 166/358
5,662,182 A 9/1997 McLeod et al. ..... 175/258
5,667,011 A 9/1997 Gill et al. ..... 166/295
5,667,023 A 9/1997 Harrell et al. ..... 175/45
5,667,026 A 9/1997 Lorenz et al. ..... 175/162
5,697,442 A 12/1997 Baldridge
5,706,894 A 1/1998 Hawkins, III
5,706,905 A 1/1998 Barr
5,711,382 A 1/1998 Hansen et al. ..... 175/52
5,717,334 A 2/1998 Vail, III et al.
5,720,356 A 2/1998 Gardes ..... 175/62
5,730,471 A 3/1998 Schulze-Beckinghausen et al.
5,732,776 A 3/1998 Tubel et al. ..... 166/250.15
5,735,348 A 4/1998 Hawkins, III ..... 166/285
5,735,351 A 4/1998 Helms
5,743,344 A 4/1998 McLeod et al. ..... 175/259
5,746,276 A 5/1998 Stuart ..... 173/1
5,769,160 A 6/1998 Owens ..... 166/65.1
5,772,514 A 6/1998 Moore
5,785,132 A 7/1998 Richardson et al.
5,785,134 A 7/1998 McLeod et al. ..... 175/258
5,787,978 A 8/1998 Carter et al.
5,791,410 A 8/1998 Castille et al.
5,794,703 A 8/1998 Newman et al.
5,803,191 A 9/1998 Mackintosh
5,803,666 A 9/1998 Keller
5,804,713 A 9/1998 Kluth ..... 73/152.01
5,813,456 A 9/1998 Milner et al.
5,823,264 A 10/1998 Ringgenberg
5,826,651 A 10/1998 Lee et al.
5,828,003 A 10/1998 Thomeer et al. ..... 174/69
5,829,520 A 11/1998 Johnson ..... 166/250.1
5,833,002 A 11/1998 Holcombe
5,836,395 A 11/1998 Budde
5,836,409 A 11/1998 Vail, III
5,839,330 A 11/1998 Stokka ..... 81/57.33
5,839,515 A 11/1998 Yuan et al.
5,839,519 A 11/1998 Spedale, Jr. ..... 175/57
5,842,149 A 11/1998 Harrell et al. ..... 702/9
5,842,530 A 12/1998 Smith et al. ..... 175/162
5,845,722 A 12/1998 Makohl et al. ..... 175/101
5,850,877 A 12/1998 Albright et al.
5,860,474 A 1/1999 Stoltz et al. ..... 166/50
5,878,815 A 3/1999 Collins
5,887,655 A 3/1999 Haugen et al.
5,887,668 A 3/1999 Haugen et al.
5,890,537 A 4/1999 Lavaure et al. ..... 166/285
5,890,549 A 4/1999 Sprehe ..... 175/71
5,894,897 A 4/1999 Vail, III ..... 175/318
5,907,664 A 5/1999 Wang et al.
5,908,049 A 6/1999 Williams et al. ..... 138/125
5,909,768 A 6/1999 Castille et al.
5,913,337 A 6/1999 Williams et al. ..... 138/125
5,921,285 A 7/1999 Quigley et al. ..... 138/125
5,921,332 A 7/1999 Spedale, Jr. ..... 175/415
5,931,231 A 8/1999 Mock ..... 166/377
5,947,213 A 9/1999 Angle et al. ..... 175/24
5,950,742 A 9/1999 Caraway ..... 175/57
5,954,131 A 9/1999 Sallwasser ..... 166/254.2
5,957,225 A 9/1999 Sinor ..... 175/57
5,960,881 A 10/1999 Allamon et al.
5,971,079 A 10/1999 Mullins ..... 166/387
5,971,086 A 10/1999 Bee et al.
5,984,007 A 11/1999 Yuan et al.
5,988,273 A 11/1999 Monjure et al.
6,000,472 A 12/1999 Albright et al. ..... 166/380
6,012,529 A 1/2000 Mikolajczyk et al.
6,024,169 A 2/2000 Haugen
6,026,911 A 2/2000 Angle et al. ..... 175/24
6,035,953 A 3/2000 Rear
6,056,060 A 5/2000 Abrahamsen et al.
6,059,051 A 5/2000 Jewkes et al. ..... 175/76
6,059,053 A 5/2000 McLeod ..... 175/258
6,061,000 A 5/2000 Edwards ..... 340/854.6

6,062,326 A 5/2000 Strong et al. ..... 175/402
6,065,550 A 5/2000 Gardes ..... 175/62
6,070,500 A 6/2000 Dlask et al.
6,070,671 A 6/2000 Cumming et al.
6,079,498 A 6/2000 Lima et al.
6,079,509 A 6/2000 Bee et al.
6,082,461 A 7/2000 Newman et al. ..... 166/381
6,089,323 A 7/2000 Newman et al. ..... 166/381
6,098,717 A 8/2000 Bailey et al.
6,119,772 A 9/2000 Pruet ..... 166/81.1
6,135,208 A 10/2000 Gano et al.
6,142,545 A 11/2000 Penman et al.
6,148,664 A 11/2000 Baird ..... 73/152.38
6,155,360 A 12/2000 McLeod
6,158,531 A 12/2000 Vail, III ..... 175/318
6,161,617 A 12/2000 Gjedebo
6,170,573 B1 1/2001 Brunet et al. ..... 166/153
6,172,010 B1 1/2001 Argillier et al. ..... 507/102
6,173,777 B1 1/2001 Mullins
6,173,787 B1 1/2001 Wittrisch
6,179,055 B1 1/2001 Sallwasser et al. ..... 166/254.2
6,179,058 B1 1/2001 Wittrisch
6,182,776 B1 2/2001 Asberg ..... 175/300
6,186,233 B1 2/2001 Brunet
6,189,616 B1 2/2001 Gano et al.
6,189,621 B1 2/2001 Vail, III ..... 166/385
6,192,980 B1 2/2001 Tubel et al. ..... 166/65.1
6,196,336 B1 3/2001 Fincher et al. ..... 175/101
6,199,641 B1 3/2001 Downie et al.
6,202,764 B1 3/2001 Ables et al.
6,206,112 B1 3/2001 Dickinson, III et al. ..... 175/67
6,216,533 B1 4/2001 Woloson et al.
6,217,258 B1 4/2001 Yamamoto et al.
6,220,117 B1 4/2001 Butcher ..... 76/108.2
6,223,823 B1 5/2001 Head
6,225,719 B1 5/2001 Hallundbaek ..... 310/90
6,227,587 B1 5/2001 Terral
6,234,257 B1 5/2001 Ciglenec et al. ..... 175/50
6,237,684 B1 5/2001 Bouligny, Jr. et al.
6,241,028 B1 6/2001 Bijleveld et al.
6,241,031 B1 6/2001 Beaufort et al.
6,257,332 B1 7/2001 Vidrine et al. ..... 166/250.15
6,263,987 B1 7/2001 Vail, III
6,273,189 B1 8/2001 Gissler et al. ..... 166/241.1
6,275,938 B1 8/2001 Bond et al.
6,290,432 B1 9/2001 Exley et al.
6,296,066 B1 10/2001 Terry et al. ..... 175/92
6,305,469 B1 10/2001 Coenen et al.
6,309,002 B1 10/2001 Bouligny
6,311,792 B1 11/2001 Scott et al. ..... 175/162
6,315,051 B1 11/2001 Ayling ..... 166/380
6,318,470 B1 11/2001 Chang et al.
6,325,148 B1 12/2001 Trahan et al. ..... 166/297
6,343,649 B1 2/2002 Beck et al. ..... 166/250.01
6,345,669 B1 2/2002 Buyers et al.
6,347,674 B1 2/2002 Bloom et al. ..... 175/51
6,349,764 B1 2/2002 Adams et al.
6,354,373 B1 3/2002 Vercaemer et al. ..... 166/277
6,357,485 B2 3/2002 Quigley et al. ..... 138/125
6,359,569 B2 3/2002 Beck et al. ..... 340/856.3
6,360,633 B2 3/2002 Pietras
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al. ..... 176/6
6,376,337 B1 4/2002 Wang et al.
6,378,627 B1 4/2002 Tubel et al. ..... 175/24
6,378,630 B1 4/2002 Ritorto et al. ..... 175/173
6,378,633 B1 4/2002 Moore et al.
6,390,190 B2 5/2002 Mullins
6,392,317 B1 5/2002 Hall et al.
6,397,946 B1 6/2002 Vail, III ..... 166/250.01
6,405,798 B1 6/2002 Barrett et al. ..... 166/250.01
6,408,943 B1 6/2002 Schultz et al. ..... 166/285
6,412,554 B1 7/2002 Allen et al. ..... 166/80.1
6,412,574 B1 7/2002 Wardley et al. ..... 175/7
6,419,014 B1 7/2002 Meek et al. ..... 166/255.2
6,419,033 B1 7/2002 Hahn et al. ..... 176/61
6,427,776 B1 8/2002 Hoffman et al. ..... 166/311
6,429,784 B1 8/2002 Beique et al.
6,431,626 B1 8/2002 Bouligny
6,443,241 B1 9/2002 Juhasz et al. ..... 175/52
6,443,247 B1 9/2002 Wardley ..... 175/402
6,446,723 B1 9/2002 Ramons et al.
6,457,532 B1 10/2002 Simpson
6,458,471 B2 10/2002 Lovato et al.
6,464,004 B1 10/2002 Crawford et al. ..... 166/250.01
6,464,011 B2 10/2002 Tubel
6,484,818 B2 11/2002 Alft et al. ..... 175/45
6,497,280 B2 12/2002 Beck et al. ..... 166/250.07
6,509,301 B1 1/2003 Vollmer ..... 507/236
6,527,047 B1 3/2003 Pietras ..... 166/77.51
6,527,064 B1 3/2003 Hallundbaek ..... 175/320
6,527,493 B1 3/2003 Kamphorst et al.
6,536,520 B1 3/2003 Snider et al. ..... 166/78.1
6,536,522 B2 3/2003 Birckhead et al.
6,536,993 B2 3/2003 Strong et al.
6,538,576 B1 3/2003 Schultz et al. ..... 340/859.6
6,540,025 B2 4/2003 Scott et al.
6,543,538 B2 4/2003 Tolman et al. ..... 166/284
6,543,552 B1 4/2003 Metcalfe et al.
6,547,017 B1 4/2003 Vail, III
6,553,825 B1 4/2003 Boyd
6,554,064 B1 4/2003 Restarick et al. ..... 166/250.01
6,585,040 B2 7/2003 Hanton et al.
6,591,471 B1 7/2003 Hollingsworth et al. . 29/407.09
6,595,288 B2 7/2003 Mosing et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,040 B1 3/2004 Sensenig
6,708,769 B2 3/2004 Haugen et al.
6,715,430 B2 4/2004 Choi et al.
6,719,071 B1 4/2004 Moyes
6,725,924 B2 4/2004 Davidson et al.
6,725,938 B1 4/2004 Pietras
6,732,822 B2 5/2004 Slack et al.
6,742,584 B1 6/2004 Appleton
6,742,596 B2 6/2004 Haugen
6,742,606 B2 6/2004 Metcalfe et al.
6,745,834 B2 6/2004 Davis et al.
6,752,211 B2 6/2004 Dewey et al.
6,776,233 B2 8/2004 Meehan
6,832,656 B2 12/2004 Cameron
6,832,658 B2 12/2004 Keast
6,837,313 B2 1/2005 Hosie et al.
6,840,322 B2 1/2005 Haynes et al.
6,848,517 B2 2/2005 Wardley
6,854,533 B2 2/2005 Galloway et al.
6,857,486 B2 2/2005 Chitwood et al.
6,857,487 B2 2/2005 Galloway et al.
6,868,906 B1 3/2005 Vail, III et al.
6,877,553 B2 4/2005 Cameron

| | | | |
|---|---|---|---|
| 6,892,835 | B2 | 5/2005 | Shahin et al. |
| 6,896,075 | B2 | 5/2005 | Haugen et al. |
| 6,899,186 | B2 | 5/2005 | Galloway et al. |
| 6,899,772 | B1 | 5/2005 | Buytaert et al. |
| 2001/0000101 | A1 | 4/2001 | Lovato et al. |
| 2001/0002626 | A1 | 6/2001 | Frank et al. |
| 2001/0013412 | A1 | 8/2001 | Tubel |
| 2001/0040054 | A1 | 11/2001 | Haugen et al. |
| 2001/0042625 | A1 | 11/2001 | Appleton |
| 2001/0047883 | A1 | 12/2001 | Hanton et al. |
| 2002/0040787 | A1 | 4/2002 | Cook et al. |
| 2002/0066556 | A1 | 6/2002 | Goode et al. |
| 2002/0070842 | A1 | 6/2002 | Bailey et al. |
| 2002/0071922 | A1 | 6/2002 | Bailey et al. |
| 2002/0074127 | A1 | 6/2002 | Birckhead et al. |
| 2002/0074132 | A1 | 6/2002 | Juhasz et al. |
| 2002/0079102 | A1 | 6/2002 | Dewey et al. |
| 2002/0108748 | A1 | 8/2002 | Keyes |
| 2002/0134555 | A1 | 9/2002 | Allen et al. |
| 2002/0157829 | A1 | 10/2002 | Davis et al. |
| 2002/0162690 | A1 | 11/2002 | Hanton et al. |
| 2002/0170720 | A1 | 11/2002 | Haugen |
| 2002/0189806 | A1 | 12/2002 | Davidson et al. |
| 2002/0189863 | A1 | 12/2002 | Wardley |
| 2003/0029641 | A1 | 2/2003 | Meehan |
| 2003/0029841 | A1 | 2/2003 | Meehan |
| 2003/0034177 | A1 | 2/2003 | Chitwood et al. |
| 2003/0056947 | A1 | 3/2003 | Cameron |
| 2003/0056991 | A1 | 3/2003 | Hahn et al. |
| 2003/0070841 | A1 | 4/2003 | Merecka et al. |
| 2003/0111267 | A1 | 6/2003 | Pia |
| 2003/0141111 | A1 | 7/2003 | Pia |
| 2003/0146023 | A1 | 8/2003 | Pia |
| 2003/0164250 | A1 | 9/2003 | Wardley |
| 2003/0164251 | A1 | 9/2003 | Tulloch |
| 2003/0164276 | A1 | 9/2003 | Snider et al. |
| 2003/0173073 | A1 | 9/2003 | Snider et al. |
| 2003/0173090 | A1 | 9/2003 | Cook et al. |
| 2003/0213598 | A1 | 11/2003 | Hughes |
| 2003/0217865 | A1 | 11/2003 | Simpson et al. |
| 2003/0221519 | A1 | 12/2003 | Haugen et al. |
| 2004/0000405 | A1 | 1/2004 | Fournier, Jr. et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0016575 | A1 | 1/2004 | Shahin et al. |
| 2004/0060697 | A1 | 4/2004 | Tilton et al. |
| 2004/0069500 | A1 | 4/2004 | Haugen |
| 2004/0069501 | A1 | 4/2004 | Haugen et al. |
| 2004/0079533 | A1 | 4/2004 | Buytaert et al. |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Kolthan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0096846 | A1 | 5/2005 | Koithan et al. |

FOREIGN PATENT DOCUMENTS

| | | |
|---|---|---|
| CA | 2 335 192 | 11/2001 |
| DE | 3 213 464 | 10/1983 |
| DE | 3 523 221 | 2/1987 |
| DE | 3 918 132 | 12/1989 |
| DE | 4 133 802 | 10/1992 |
| EP | 0 087 373 | 8/1983 |
| EP | 0 162 000 | 11/1985 |
| EP | 0 171 144 | 2/1986 |
| EP | 0 235 105 | 9/1987 |
| EP | 0 265 344 | 4/1988 |
| EP | 0 285 386 | 10/1988 |
| EP | 0 426 123 | 5/1991 |
| EP | 0 462 618 | 12/1991 |
| EP | 0 474 481 | 3/1992 |
| EP | 0479583 | 4/1992 |
| EP | 0 525 247 | 2/1993 |
| EP | 0 554 568 | 8/1993 |
| EP | 0 589 823 | 3/1994 |
| EP | 0 564 500 B1 | 10/1994 |
| EP | 0 659 975 | 6/1995 |
| EP | 0 790 386 | 8/1997 |
| EP | 0 881 354 | 4/1998 |
| EP | 0 571 045 | 8/1998 |
| EP | 0 961 007 | 12/1999 |
| EP | 0 962 384 | 12/1999 |
| EP | 1 006 260 | 6/2000 |
| EP | 1 050 661 | 11/2000 |
| EP | 1148206 | 10/2001 |
| EP | 1 256 691 | 11/2002 |
| FR | 2053088 | 7/1970 |
| FR | 2741907 | 6/1997 |
| FR | 2 841 293 | 12/2003 |
| GB | 540 027 | 10/1941 |
| GB | 709 365 | 5/1954 |
| GB | 709365 | 5/1954 |
| GB | 716 761 | 10/1954 |
| GB | 716761 | 10/1954 |
| GB | 7 928 86 | 4/1958 |
| GB | 8 388 33 | 6/1960 |
| GB | 881 358 | 11/1961 |
| GB | 881358 | 11/1961 |
| GB | 9 977 21 | 7/1965 |
| GB | 1 277 461 | 6/1972 |
| GB | 1 306 568 | 3/1973 |
| GB | 1 448 304 | 9/1976 |
| GB | 1 469 661 | 4/1977 |
| GB | 1 582 392 | 1/1981 |
| GB | 2 053 088 | 2/1981 |
| GB | 2 115 940 | 9/1983 |
| GB | 2 170 528 | 8/1986 |
| GB | 2 201 912 | 9/1988 |
| GB | 2 216 926 | 10/1989 |
| GB | 2 223 523 | 4/1990 |
| GB | 2 224 481 | 9/1990 |
| GB | 2 240 799 | 8/1991 |
| GB | 2 275 486 | 4/1993 |
| GB | 2 294 715 | 8/1996 |
| GB | 2294715 | 8/1996 |
| GB | 2 313 860 | 2/1997 |
| GB | 2 320 270 | 6/1998 |
| GB | 2 324 108 | 10/1998 |
| GB | 2 333 542 | 7/1999 |
| GB | 2 335 217 | 9/1999 |
| GB | 2 345 074 | 6/2000 |
| GB | 2 348 223 | 9/2000 |
| GB | 2347445 | 9/2000 |
| GB | 2 349 401 | 11/2000 |

| | | |
|---|---|---|
| GB | 2 350 137 | 11/2000 |
| GB | 2 357 101 | 6/2001 |
| GB | 2 357 530 | 6/2001 |
| GB | 2 352 747 | 7/2001 |
| GB | 2 365 463 | 2/2002 |
| GB | 2 372 271 | 8/2002 |
| GB | 2 372 765 | 9/2002 |
| GB | 2 382 361 | 5/2003 |
| GB | 2381809 | 5/2003 |
| GB | 2 386 626 | 9/2003 |
| GB | 2 389 130 | 12/2003 |
| RU | 2 079 633 | 5/1997 |
| SU | 112631 | 1/1956 |
| SU | 659260 | 4/1967 |
| SU | 247162 | 5/1967 |
| SU | 395557 | 12/1971 |
| SU | 415346 | 3/1972 |
| SU | 481689 | 6/1972 |
| SU | 461218 | 4/1973 |
| SU | 501139 | 12/1973 |
| SU | 585266 | 7/1974 |
| SU | 583278 | 8/1974 |
| SU | 601390 | 1/1976 |
| SU | 581238 | 2/1976 |
| SU | 655843 | 3/1977 |
| SU | 781312 | 3/1978 |
| SU | 899820 | 6/1979 |
| SU | 955765 | 2/1981 |
| SU | 1304470 | 8/1984 |
| SU | 1618870 | 1/1991 |
| SU | 1808972 | 5/1991 |
| WO | WO 90/06418 | 6/1990 |
| WO | WO 91/16520 | 10/1991 |
| WO | WO 92/01139 | 1/1992 |
| WO | WO 92/18743 | 10/1992 |
| WO | WO 92/20899 | 11/1992 |
| WO | WO 93/07358 | 4/1993 |
| WO | WO 93/18277 | 9/1993 |
| WO | WO 93/24728 | 12/1993 |
| WO | WO 95/10686 | 4/1995 |
| WO | WO 95/21987 | 8/1995 |
| WO | WO 96/18799 | 6/1996 |
| WO | WO 96/28635 | 9/1996 |
| WO | WO 97/05360 | 2/1997 |
| WO | WO 97/08418 | 3/1997 |
| WO | WO 98/01651 | 1/1998 |
| WO | WO 98/05844 | 2/1998 |
| WO | WO 98/06927 | 2/1998 |
| WO | WO 98/09053 | 3/1998 |
| WO | WO 98/11322 | 3/1998 |
| WO | WO 98/32948 | 7/1998 |
| WO | WO 98/55730 | 12/1998 |
| WO | WO 99/04135 | 1/1999 |
| WO | WO 99/11902 | 3/1999 |
| WO | WO 99/23354 | 5/1999 |
| WO | WO 99/24689 | 5/1999 |
| WO | WO 99/35368 | 7/1999 |
| WO | WO 99/37881 | 7/1999 |
| WO | WO 99/41485 | 8/1999 |
| WO | WO 99/50528 | 10/1999 |
| WO | WO 99/58810 | 11/1999 |
| WO | WO 99/64713 | 12/1999 |
| WO | WO 00-04269 | 1/2000 |
| WO | WO 00/05483 | 2/2000 |
| WO | WO 00/08293 | 2/2000 |
| WO | WO 00-09853 | 2/2000 |
| WO | WO 00/11309 | 3/2000 |
| WO | WO 00/11310 | 3/2000 |
| WO | WO 00/11311 | 3/2000 |
| WO | WO 00/28188 | 5/2000 |
| WO | WO 00/37766 | 6/2000 |
| WO | WO 00/37771 | 6/2000 |
| WO | WO 00/39429 | 7/2000 |
| WO | WO 00/39430 | 7/2000 |
| WO | WO 00/46484 | 8/2000 |
| WO | WO 00/50730 | 8/2000 |
| WO | WO 0050730 | 8/2000 |
| WO | WO 00/66879 | 11/2000 |
| WO | WO 01/12946 | 2/2001 |
| WO | WO 01/46550 | 6/2001 |
| WO | WO 01/48352 | 7/2001 |
| WO | WO 01/79650 | 10/2001 |
| WO | WO 01/81708 | 11/2001 |
| WO | WO 01/83932 | 11/2001 |
| WO | WO 01/94738 | 12/2001 |
| WO | WO 01/94739 | 12/2001 |
| WO | WO 02/03155 | 1/2002 |
| WO | WO 02/03156 | 1/2002 |
| WO | WO 02/44601 | 6/2002 |
| WO | WO 02/081863 | 10/2002 |
| WO | WO 02/086287 | 10/2002 |
| WO | WO 03-006790 | 1/2003 |
| WO | WO 03/074836 | 9/2003 |
| WO | WO 03/087525 | 10/2003 |
| WO | WO 04-022903 | 3/2004 |

OTHER PUBLICATIONS

Detlef Hahn, Friedhelm Makohl, and Larry Watkins, Casing-While Drilling System Reduces Hole Collapse Risks, Offshore, pp. 54, 56, and 59, Feb. 1998.

Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pp. 351-464.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Valves Wellhead Equipment Safety Systems, W-K-M Division, ACF Industries, Catalog 80, 1980, 5 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Rotary Drilling, The Drill Stem, Unit I, Lesson 3, Second Edition, The University of Texas at Austin, Austin, Texas.

Rotary Drilling Series, The Rotary Rig and Its Components, Unit I, Lesson 1, Third Edition, The University of Texas at Austin, Austin, Texas.

Hahn, et al., "Simultaneous Drill and Case Technology—Case Histories, Status and Options for Further Development," Society of Petroleum Engineers, IADC/SPE Drilling Conference, New Orlean, LA Feb. 23-25, 2000 pp. 1-9.

M.B. Stone and J. Smith, "Expandable Tubulars and Casing Drilling are Options" Drilling Contractor, Jan./Feb. 2002, pp. 52.

M. Gelfgat, "Retractable Bits Development and Application" Transactions of the ASME, vol. 120, Jun. (1998), pp. 124-130.

"First Success with Casing-Drilling" Word Oil, Feb. (1999), pp. 25.

Dean E. Gaddy, Editor, "Russia Shares Technical Know-How with U.S." Oil & Gas Journal, Mar. (1999), pp. 51-52 and 54-56.

U.S. Appl. No. 10/794,800, filed Mar. 5, 2004.

U.S. Appl. No. 10/832,804, filed Apr. 27, 2004.

U.S. Appl. No. 10/795,214, filed Mar. 5, 2004.

U.S. Appl. No. 10/794,795, filed Mar. 5, 2004.

U.S. Appl. No. 10/775,048, filed Feb. 9, 2004.

U.S. Appl. No. 10/772,217, filed Feb. 2, 2004.
U.S. Appl. No. 10/788,976, filed Feb. 27, 2004.
U.S. Appl. No. 10/794,797, filed Mar. 5, 2004.
U.S. Appl. No. 10/767,322, filed Jan. 29, 2004.
U.S. Appl. No. 10/795,129, filed Mar. 5, 2004.
U.S. Appl. No. 10/794,790, filed Mar. 5, 2004.
U.S. Appl. No. 10/162,302, filed Jun. 4, 2004.
Rotary Steerable Technology—Technology Gains Momentum, Oil & Gas Journal, Dec. 28, 1998.
Directional Drilling, M. Mims, World Oil, May 1999, pp. 40-43.
Multilateral Classification System w/Example Applications, Alan MacKenzie & Cliff Hogg, World Oil, Jan. 1999, pp. 55-61.
Rotary Drilling, Open-Hole Fishing, Unit III, Lesson 2, Third Edition.
Rotary Drilling, Casing and Cementing, Unit II, Lesson 4, Second Edition.
Rotary Drilling, Drilling a Straight Hole, Unit II, Lesson 3, Second Edition.
Rotary Drilling, The Bit, Unit I, Lesson 2, Third Edition.
Rotary Drilling, Blowout Prevention, Unit III, Lesson 3, Third Edition.
Well Servicing and Workover, Artificial Lift Methods, Lesson 5, Petroleum Extension Service, The University of Texas at Austin.
Rotary Drilling, Drilling Mud, Unit II, Lesson 2, Third Edition.
Rotary Drilling, Subsea Blowout Preventers and Marine Riser Systems, Unit III, Lesson 4.
Well Servicing and Workover, Control of Formation Pressure, Lesson 9, Petroleum Extension Service, The University of Texas at Austin.
Well Servicing and Workover, Production Rig Equipment, Lesson 6, Petroleum Extension Service, The University of Texas at Austin.
Well Servicing and Workover, Petroleum Geology and Reservoirs, Lesson 2, Petroleum Extension Service, The University of Texas at Austin.
Well Servicing and Workover, Well Logging Methods, Lesson 3, Petroleum Extension Service, The University of Texas at Austin.
Well Servicing and Workover, Introduction to Oil Well Service and Workover, Lesson 1, Petroleum Extension Service, The University of Texas at Austin.
Well Servicing and Workover, Well Completion Methods, Lesson 4, Petroleum Extension Service, The University of Texas at Austin.
Rotary Drilling, Controlled Directional Drilling, Unit III, Lesson 1, Third Edition.
Well Servicing and Workover, Well Stimulation Treatments, Lesson 11, Petroleum Extension Service, The University of Texas at Austin.
Rotary Drilling, Making Hole, Unit II, Lesson 1, Second Edition.
Well Servicing and Workover, Well Cleanout and Repair Methods, Lesson 8, Petroleum Extension Service, The University of Texas at Austin.
Well Servicing and Workover, Well Servicing and Repair, Lesson 7, Petroleum Extension Service, The University of Texas at Austin.
Rotary Drilling, Circulating Systems, Unit I, Lesson 8, Third Edition.
Well Servicing and Workover, Well Service and Workover Profitability, Lesson 12, Petroleum Extension Service, The University of Texas at Austin.
Rotary Drilling, Testing and Completing, Unit II, Lesson 5, Second Edition.
Well Servicing and Workover, Fishing Tools and Techniques, Lesson 10, Petroleum Extension Service, The University of Texas at Austin.
U.S. Appl. No. 10/618,093.
U.S. Appl. No. 10/382,353.
U.S. Appl. No. 10/382,080.
U.S. Appl. No. 10/335,957.
U.S. Appl. No. 10/331,964.
U.S. Appl. No. 10/325,636.
U.S. Appl. No. 10/319,792.
U.S. Appl. No. 10/269,661.
U.S. Appl. No. 10/189,570.
Tarr, et al., "Casing-while-Drilling: The Next Step Change In Well Construction," World Oil, Oct. 1999, pp. 34-40.
De Leon Mojarro, "Breaking A Paradigm: Drilling With Tubing Gas Wells," SPE Paper 40051, SPE Annual Technical Conference And Exhibition, Mar. 3-5, 1998, pp. 465-472.
De Leon Mojarro, "Drilling/Completing With Tubing Cuts Well Costs By 30%," World Oil, Jul. 1998, pp. 145-150.
Littleton, "Refined Slimhole Drilling Technology Renews Operator Interest," Petroleum Engineer International, Jun. 1992, pp. 19-26.
Anon, "Slim Holes Fat Savings," Journal of Petroleum Technology, Sep. 1992, pp. 816-819.
Anon, "Slim Holes, Slimmer Prospect," Journal of Petroleum Technology, Nov. 1995, pp. 949-952.
Vogt, et al., "Drilling Liner Technology For Depleted Reservoir," SPE Paper 36827, SPE Annual Technical Conference And Exhibition, Oct. 22-24, pp. 127-132.
Jafer, et al., "Discussion And Comparison Of Performance Of Horizontal Wells In Bouri Field," SPE Paper 36927, SPE Annual Technical Conference And Exhibition, Oct. 22-24, 1996, pp. 465-473.
Boykin, "The Role Of A Worldwide Drilling Organization And The Road To The Future," SPE/IADC Paper 37630, SPE/IADC Drilling Conference, Mar. 4-6, 1997, pp. 489-498.
Mojarro, et al., "Drilling/Completing With Tubing Cuts Well Costs By 30%," World Oil, Jul. 1998, pp. 145-150.
Sinor, et al., Rotary Liner Drilling For Depleted Reservoirs, IADC/SPE Paper 39399, IADC/SPE Drilling Conference, Mar. 3-6, 1998, pp. 1-13.
Editor, "Innovation Starts At The Top At Tesco," The American Oil & Gas Reporter, Apr., 1998, p. 65.
Tessari, et al., "Casing Drilling—A Revolutionary Approach To Reducing Well Costs," SPE/IADC Paper 52789, SPE/IADC Drilling Conference, Mar. 9-11, 1999, pp. 221-229.
Santos, et al., "Consequences And Relevance Of Drillstring Vibration On Wellbore Stability," SPE/IADC Paper 52820, SPE/IADC Drilling Conference, Mar. 9-11, 1999, pp. 25-31.
Silverman, "Novel Drilling Method—Casing Drilling Process Eliminates Tripping String," Petroleum Engineer International, Mar. 1999, p. 15.
Silverman, "Drilling Technology—Retractable Bit Eliminates Drill String Trips," Petroleum Engineer International, Apr. 1999, p. 15.
Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.
Madell, et al., "Casing Drilling An Innovative Approach To Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I—Casing Drilling With Directional Steering In The U.S. Gulf Of Mexico," Offshore, Jan. 2001, pp. 50-52.
Warren, et al., "Drilling Technology: Part II—Casing Drilling With Directional Steering In The Gulf Of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves To More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied In Southern Wyoming," World Oil, Jun. 2002, pp. 33-41.

Forest, et al., "Subsea Equipment For Deep Water Drilling Using Dual Gradient Mud System," SPE/IADC Drilling Conference, Amsterdam, The Netherlands, Feb. 27, 2001-Mar. 1, 2001, 8 pages.
World's First Drilling With Casing Operation From A Floating Drilling Unit, Sep. 2003, 1 page.
Filippov, et al., "Expandable Tubular Solutions," SPE paper 56500, SPE Annual Technical Conference And Exhibition, Oct. 3-6, 1999, pp. 1-16.
Lohefer, et al., "Expandable Liner Hanger Provides Cost-Effective Alternative Solution," IADC/SPE Paper 59151, IADC/SPE Drilling Conference, Feb. 23-25, 2000, pp. 1-12.
Daigle, et al., "Expandable Tubulars: Field Examples Of Application In Well Construction And Remediation," SPE Paper 62958, SPE Annual Technical Conference And Exhibition, Oct. 1-4, 2000, pp. 1-14.
Dupal, et al., "Solid Expandable Tubular Technology—A Year Of Case Histories In The Drilling Environment," SPE/IADC Paper 67770, SP:E/IADC Drilling Conference, Feb. 27-Mar. 1, 2001, pp. 1-16.
Coronado, et al., "Development Of A One-Trip ECP Cement Inflation And Stage Cementing System For Open Hole Completions," IADC/SPE Paper 39345, IADC/SPE Drilling Conference, Mar. 3-6, 1998, pp. 473-481.
Fuller, et al., Innovative Way To Cement A Liner Utilizing A New Liner String Liner Cementing Process, IADC/SPE Paper 39349, IADC/SPE Drilling Conference, Mar. 3-6, 1998, pp. 501-504.
Coronado, et al., "A One-Trip External-Casing-Packer Cement-Inflation And Stage-Cementing System," Journal Of Petroleum Technology, Aug. 1998, pp. 76-77.
Camesa, Inc., "Electromechanical Cable," Dec. 1998, pp. 1-32.
The Rochester Corporation, "Well Logging Cables," Jul. 1999, 9 pages.
Quigley, "Coiled Tubing And Its Applications," SPE Short Course, Houston, Texas, Oct. 3, 1999, 9 pages.
"World Oil's Coiled Tubing handbook," Gulf Publishing Co., 1993, p. 3, p. 5, pp. 45-50.
Sas-Joworsky, et al., "Development Of Composite Coiled Tubing For Oilfield Services," SPE Paper 26536, SPE Annual Technical Conference And Exhibition, Oct. 3-6, 1993, pp. 1-15.
Hallundbaek, "Well Tractors For Highly Deviated And Horizontal Wells," SPE paper 028871, SPE European Petroleum Conference, Oct. 25-27, 1994, pp. 57-62.
Leising, et al., "Extending The Reach Of Coiled Tubing Drilling (thrusters, Equalizers And Tractors)," SPE/IADC Paper 37656, SPE/IADC Drilling Conference, Mar. 4-6, 1997, pp. 677-690.
Bayfiled, et al., "Burst And Collapse Of A Sealed Multilateral Junction: Numerical Simulations," SPE/IADC Paper 52873, SPE/IADC Drilling Conference, Mar. 9-11, 1999, 8 pages.
Marker, et al. "Anaconda: Joint Development Project Leads To Digitally Controlled Composite Coiled Tubing Drilling System," SPE paper 60750, SPE/ICOTA Coiled Tubing Roundtable, Apr. 5-6, 2000, pp. 1-9.
Bullock, et al., "Using Expandable Solid Tubulars To Solve Well Construction Challenges In Deep Waters And Maturing Properties," IBP Paper 275 00, Rio Oil & Gas Conference, Oct. 16-19, 2000, pp. 1-4.
Cales, et al., Subsidence Remediation—Extending Well Life Through The Use Of Solid Expandable Casing Systems, AADE Paper 01-NC-HO-24, American Association Of Drilling Engineers, Mar. 2001 Conference, pp. 1-16.
McSpadden, et al., "Field Validation Of 3-Dimensional Drag Model For Tractor And Cable-Conveyed Well Intervention," SPE Paper 71560, SPE Annual Technical Confernece And Exhibition, Sep. 30-Oct. 3, 2001, pp. 1-8.
Coats, et al., "The Hybrid Drilling Unite: An Overview Of an Integrated Composite Coiled Tubing And Hydraulic Workover Drilling System," SPE Paper 74349, SPE International Petroleum Conference And Exhibition, Feb. 10-12, 2002, pp. 1-7.
Sander, et al., "Project Management And Technology Provide Enhanced Performance For Shallow Horizontal Wells," IADC/SPE Paper 74466, IADC/SPE Drilling Conference, Feb. 26-28, 2002, pp. 1-9.
Coats, et al., The Hybrid Drilling System: Incorporating Composite Coiled Tubing And Hydraulic Workover Technologies Into One Integrated Drilling System, IADC/SPE Paper 74538, IADC/SPE Drilling Conference, Feb. 26-28, 2002, pp. 1-7.
Editor, "New Downhole Tractor Put To Work," World Oil, Jun. 2000, pp. 75-76.
Henderson, et al., "Cost Saving Benefits Of Using A Fully Bi-Directional Tractor System," SPE/Petroleum Society Of CIM Paper 65467, SPE/Petroleum Society Of CIM International Conference On Horizontal Well Technology, Nov. 6-8, 2000, pp. 1-3.
Editor, "Shell Runs Smart Robot Tractor," Hart's E & P, Oct. 2002, p. 28.
Galloway, "Rotary Drilling With Casing—A Field Proven Method Of Reducing Wellbore Construction Cost," Paper WOCD-0306092, World Oil Casing Drilling Technical Conference, Mar. 6-7, 2003, pp. 1-7.
Evans, et al., "Development And Testing Of An Economical Casing Connection For Use In Drilling Operations," paper WOCD-0306-03, World Oil Casing Drilling Technical Conference, Mar. 6-7, 2003, pp. 1-10.
Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.
McKay, et al., "New Developments In The Technology Of Drilling With Casing: Utilizing A Displaceable DrillShoe Tool," Paper WOCD-0306-05, World Oil Casing Drilling Technical Conference, Mar. 6-7, 2003, pp. 1-11.
Sutriono—Santos, et al., "Drilling With Casing Advances To Floating Drilling Unit With Surface BOP Employed," Paper WOCD-0307-01, World Oil Casing Drilling Technical Conferece, Mar. 6-7, 2003, pp. 1-7.
Vincent, et al., "Liner And Casing Drilling—Case Histories And Technology," Paper WOCD-0307-02, World Oil Casing Drilling Technical Conference, Mar. 6-7, 2003, pp. 1-20.
Maute, "Electrical Logging: State-of-the Art," The Log Analyst, May-Jun. 1992, pp. 206-227.
Tessari, et al., "Retrievable Tools Provide Flexibility for Casing Drilling," Paper No. WOCD-0306-01, World Oil Casing Drilling Technical Conference, 2003, pp. 1-11.

* cited by examiner

*Primary Examiner*—Frank Tsay
(74) *Attorney, Agent, or Firm*—Patterson & Sheridan, LLP

(57) ABSTRACT

The steel drill string attached to a drilling bit during typical rotary drilling operations used to drill oil and gas wells is used for a second purpose as the casing that is cemented in place during typical oil and gas well completions. Methods of operation are described that provide for the efficient installation a cemented steel cased well wherein the drill string and the drill bit are cemented into place during one single drilling pass down into the earth. The normal mud passages or watercourses present in the rotary drill bit are used for the second independent purpose of passing cement into the annulus between the casing and the well while cementing the drill string into place during one single pass into the earth. A one-way cement valve is installed near the drill bit of the drill string that allows the cement to set up efficiently under ambiently hydrostatic conditions while the drill string and drill bit are cemented into place during one single drilling pass into the earth.

31 Claims, 1 Drawing Sheet

METHOD AND APPARATUS FOR CEMENTING DRILL STRINGS IN PLACE FOR ONE PASS DRILLING AND COMPLETION OF OIL AND GAS WELLS

CROSS-REFERENCE TO RELATED APPLICATIONS

Portions of this application were disclosed in U.S. Disclosure Document No. 362582 filed on Sep. 30, 1994, which is incorporated herein by reference.

This application is a continuation of co-pending U.S. patent application Ser. No. 10/162,302, filed on Jun. 4, 2002, which is herein incorporated by reference in its entirety. U.S. patent application Ser. No. 10/162,302 is a continuation-in-part of U.S. patent application Ser. No. 09/487,197 filed on Jan. 19, 2000, now U.S. Pat. No. 6,397,946, which is herein incorporated by reference in its entirety. U.S. Pat. No. 6,397,946 is a continuation-in-part of U.S. patent application Ser. No. 09/295,808 filed on Apr. 20, 1999, now U.S. Pat. No. 6,263,987, which is herein incorporated by reference in its entirety. U.S. Pat. No. 6,263,987 is a continuation-in-part of U.S. patent application Ser. No. 08/708,396 filed on Sep. 3, 1996, now U.S. Pat. No. 5,894,897, which is incorporated herein by reference in its entirety. U.S. Pat. No. 5,894,897 is a continuation-in-part of U.S. patent application Ser. No. 08/323,152 filed on Oct. 14, 1994, now U.S. Pat. No. 5,551,521, which is herein incorporated by reference in its entirety.

This application further claims benefit of U.S. Provisional Patent Application Ser. No. 60/313,654 filed on Aug. 19, 2001, U.S. Provisional Patent Application Ser. No. 60/353,457 filed on Jan. 31, 2002, U.S. Provisional Patent Application Ser. No. 60/367,638 filed on Mar. 26, 2002, and U.S. Provisional Patent Application Ser. No. 60/384,964 filed on Jun. 3, 2002. All of the above United States Provisional Patent Applications are herein incorporated by reference in their entirety.

BACKGROUND OF THE INVENTION

1. Field of Invention

The field of invention relates to apparatus that uses the steel drill string attached to a drilling bit during drilling operations used to drill oil and gas wells for a second purpose as the casing that is cemented in place during typical oil and gas well completions. The field of invention further relates to methods of operation of said apparatus that provides for the efficient installation a cemented steel cased well during one single pass down into the earth of the steel drill string. The field of invention further relates to methods of operation of the apparatus that uses the typical mud passages already present in a typical drill bit, including any watercourses in a "regular bit", or mud jets in a "jet bit", that allow mud to circulate during typical drilling operations for the second independent, and the distinctly separate, purpose of passing cement into the annulus between the casing and the well while cementing the drill string into place during one single drilling pass into the earth. The field of invention further relates to apparatus and methods of operation that provides the pumping of cement down the drill string, through the mud passages in the drill bit, and into the annulus between the formation and the drill string for the purpose of cementing the drill string and the drill bit into place during one single drilling pass into the formation. The field of invention further relates to a one-way cement valve and related devices installed near the drill bit of the drill string that allows the cement to set up efficiently while the drill string and drill bit are cemented into place during one single drilling pass into the formation.

2. Description of the Prior Art

From an historical perspective, completing oil and gas wells using rotary drilling techniques has in recent times comprised the following typical steps. With a pile driver or rotary rig, install any necessary conductor pipe on the surface for attachment of the blowout preventer and for mechanical support at the wellhead. Install and cement into place any surface casing necessary to prevent washouts and cave-ins near the surface, and to prevent the contamination of freshwater sands as directed by state and federal regulations. Choose the dimensions of the drill bit to result in the desired sized production well. Begin rotary drilling of the production well with a first drill bit. Simultaneously circulate drilling mud into the well while drilling. Drilling mud is circulated downhole to carry rock chips to the surface, to prevent blowouts, to prevent excessive mud loss into formation, to cool the bit, and to clean the bit. After the first bit wears out, pull the drill string out, change bits, lower the drill string into the well and continue drilling. It should be noted here that each "trip" of the drill bit typically requires many hours of rig time to accomplish the disassembly and reassembly of the drill string, pipe segment by pipe segment.

Drill the production well using a succession of rotary drill bits attached to the drill string until the hole is drilled to its final depth. After the final depth is reached, pull out the drill string and its attached drill bit. Assemble and lower the production casing into the well while back filling each section of casing with mud as it enters the well to overcome the buoyancy effects of the air filled casing (caused by the presence of the float collar valve), to help avoid sticking problems with the casing, and to prevent the possible collapse of the casing due to accumulated build-up of hydrostatic pressure.

To "cure the cement under ambient hydrostatic conditions", typically execute a two-plug cementing procedure involving a first Bottom Wiper Plug before and a second Top Wiper Plug behind the cement that also minimizes cement contamination problems comprised of the following individual steps. Introduce the Bottom Wiper Plug into the interior of the steel casing assembled in the well and pump down with cement that cleans the mud off the walls and separates the mud and cement. Introduce the Top Wiper Plug into the interior of the steel casing assembled into the well and pump down with water under pump pressure thereby forcing the cement through the float collar valve and any other one-way valves present. Allow the cement to cure.

SUMMARY OF THE INVENTION

Apparatus and methods of operation of that apparatus are disclosed that allow for cementation of a drill string with attached drill bit into place during one single drilling pass into a geological formation. The process of drilling the well and installing the casing becomes one single process that saves installation time and reduces costs during oil and gas well completion procedures. Apparatus and methods of operation of the apparatus are disclosed that use the typical mud passages already present in a typical rotary drill bit, including any watercourses in a "regular bit", or mud jets in a "jet bit", for the second independent purpose of passing cement into the annulus between the casing and the well while cementing the drill string in place. This is a crucial step that allows a "Typical Drilling Process" involving some 14 steps to be compressed into the "New Drilling Process"

that involves only 7 separate steps as described in the Description of the Preferred Embodiments below. The New Drilling Process is now possible because of "Several Recent Changes in the Industry" also described in the Description of the Preferred Embodiments below. In addition, the New Drilling Process also requires new apparatus to properly allow the cement to cure under ambient hydrostatic conditions. That new apparatus includes a Latching Subassembly, a Latching Float Collar Valve Assembly, the Bottom Wiper Plug, and the Top Wiper Plug. Suitable methods of operation are disclosed for the use of the new apparatus.

DESCRIPTION OF THE PREFERRED EMBODIMENTS

Figure 1:
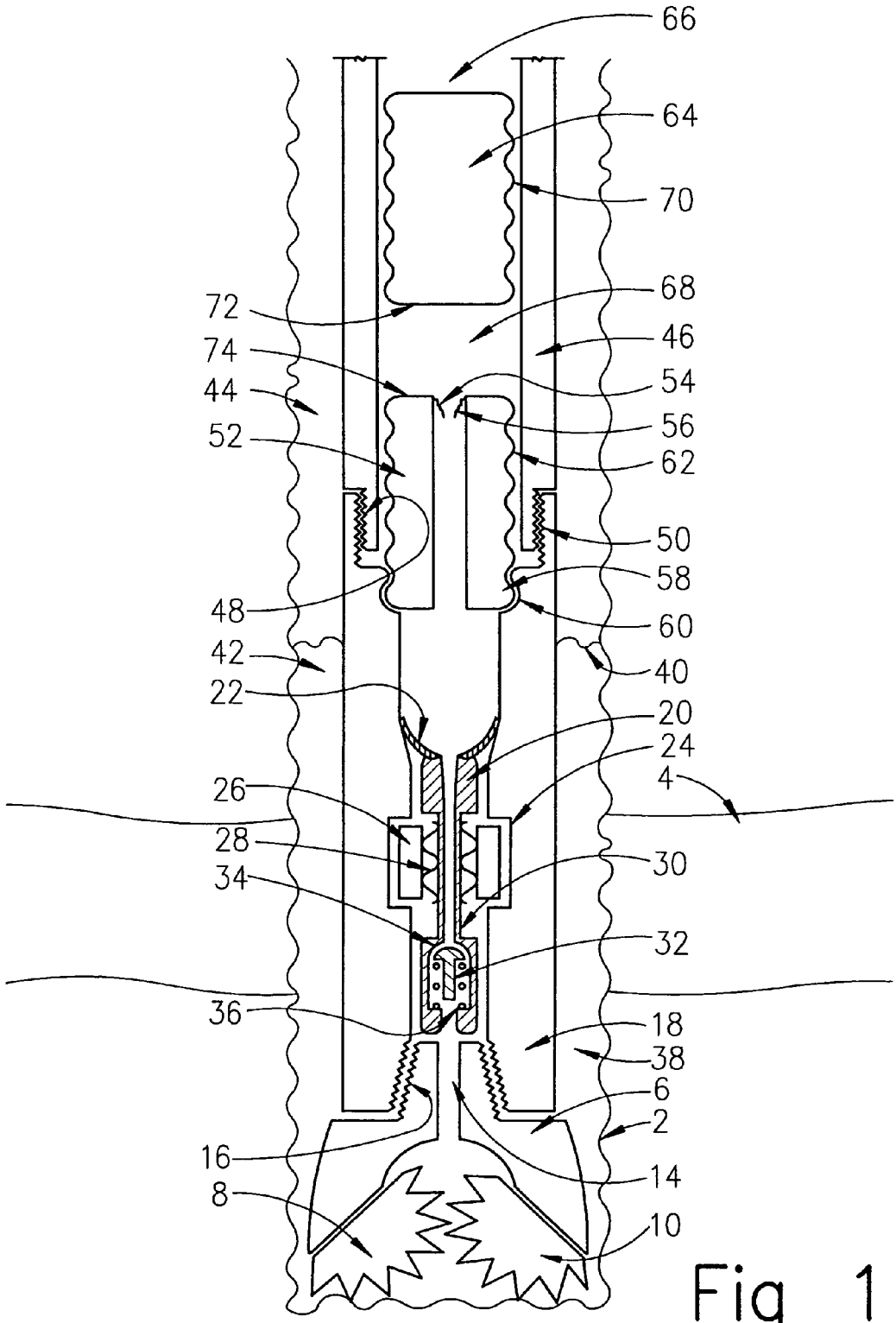
FIG. 1 shows a section view of a drill string in the process of being cemented in place during one drilling pass into formation with a preferred embodiment of the invention.

Apparatus and methods of operation of that apparatus are disclosed herein in the preferred embodiments of the invention that allow for cementation of a drill string with attached drill bit into place during one single drilling pass into a geological formation. The method of drilling the well and installing the casing becomes one single process that saves installation time and reduces costs during oil and gas well completion procedures as documented in the following description of the preferred embodiments of the invention. Apparatus and methods of operation of the apparatus are disclosed herein that use the typical mud passages already present in a typical rotary drill bit, including any watercourses in a "regular bit", or mud jets in a "jet bit", for the second independent purpose of passing cement into the annulus between the casing and the well while cementing the drill string in place.

FIG. 1 shows a section view of a drill string in the process of being cemented in place during one drilling pass into formation. A borehole 2 is drilled though the earth including geological formation 4. The borehole 2 is drilled with a milled tooth rotary drill bit 6 having milled steel roller cones 8, 10, and 12 (not shown for simplicity). A standard water passage 14 is shown through the rotary cone drill bit. This rotary bit could equally be a tungsten carbide insert roller cone bit having jets for waterpassages, the principle of operation and the related apparatus being the same for either case for the preferred embodiment herein.

The threads 16 on rotary drill bit 6 are screwed into the Latching Subassembly 18. The Latching Subassembly 18 is also called the Latching Sub for simplicity herein. The Latching Sub 18 is a relatively thick-walled steel pipe having some functions similar to a standard drill collar.

The Latching Float Collar Valve Assembly 20 is pumped downhole with drilling mud after the depth of the well is reached. The Latching Float Collar Valve Assembly 20 is pumped downhole with mud pressure pushing against the Upper Seal 22 of the Latching Float Collar Valve Assembly 20. The Latching Float Collar Valve Assembly 20 latches into place into Latch Recession 24. The Latch 26 of the Latching Float Collar Valve Assembly 20 is shown latched into place with Latching Spring 28 pushing against Latching Mandrel 30.

The Float 32 of the Latching Float Collar Valve Assembly 20 seats against the Float Seating Surface 34 under the force from Float Collar Spring 36 that makes a one-way cement valve. However, the pressure applied to the mud or cement from the surface may force open the Float to allow mud or cement to be forced into the annulus generally designated as 38 in FIG. 1. This one-way cement valve is a particular example of "a one-way cement valve means installed near the drill bit" which is a term defined herein. The one-way cement valve means may be installed at any distance from the drill bit but is preferentially installed "near" the drill bit.

FIG. 1 corresponds to the situation where cement is in the process of being forced from the surface through the Latching Float Collar Valve Assembly 20. In fact, the top level of cement in the well is designated as element 40. Below 40, cement fills the annulus of the borehole 2. Above 40, mud fills the annulus of the borehole 2. For example, cement is present at position 42 and drilling mud is present at position 44 in FIG. 1.

Relatively thin-wall casing, or drill pipe, designated as element 46 in FIG. 1, is attached to the Latching Sub 18. The bottom male threads of the drill pipe 48 are screwed into the female threads 50 of the Latching Sub 18.

The drilling mud was wiped off the walls of the drill pipe 48 in the well with Bottom Wiper Plug 52. The Bottom Wiper Plug 52 is fabricated from rubber in the shape shown. Portions 54 and 56 of the Upper Seal of the Bottom Wiper Plug 52 are shown in a ruptured condition in FIG. 1. Initially, they sealed the upper portion of the Bottom Wiper Plug 52. Under pressure from cement, the Bottom Wiper Plug 52 is pumped down into the well until the Lower Lobe 58 of the Bottom Wiper Plug 52 latches into place into Latching Sub Recession 60 in the Latching Sub 18. After the Bottom Wiper Plug 52 latches into place, the pressure of the cement ruptures the Upper Seal of the Bottom Wiper Plug 52. A Bottom Wiper Plug Lobe 62 is shown in FIG. 1. Such lobes provide an efficient means to wipe the mud off the walls of the drill pipe 48 while the Bottom Wiper Plug 52 is pumped downhole with cement.

Top Wiper Plug 64 is being pumped downhole by water 66 under pressure in the drill pipe. As the Top Wiper Plug 64 is pumped down under water pressure, the cement remaining in region 68 is forced downward through the Bottom Wiper Plug 52, through the Latching Float Collar Valve Assembly 20, through the waterpassages of the drill bit and into the annulus in the well. A Top Wiper Plug Lobe 70 is shown in FIG. 1. Such lobes provide an efficient means to wipe the cement off the walls of the drill pipe while the Top Wiper Plug 64 is pumped downhole with water.

After the Bottom Surface 72 of the Top Wiper Plug 64 is forced into the Top Surface 74 of the Bottom Wiper Plug 52, almost the entire "cement charge" has been forced into the annulus between the drill pipe and the hole. As pressure is reduced on the water, the Float of the Latching Float Latching Float Collar Valve Assembly 20 seals against the Float Seating Surface. As the water pressure is reduced on the inside of the drill pipe, then the cement in the annulus between the drill pipe and the hole can cure under ambient hydrostatic conditions. This procedure herein provides an example of the proper operation of a "one-way cement valve means".

Therefore, the preferred embodiment in FIG. 1 provides apparatus that uses the steel drill string attached to a drilling bit during drilling operations used to drill oil and gas wells for a second purpose as the casing that is cemented in place during typical oil and gas well completions.

The preferred embodiment in FIG. 1 provides apparatus and methods of operation of said apparatus that results in the efficient installation of a cemented steel cased well during one single pass down into the earth of the steel drill string thereby making a steel cased borehole or cased well.

The steps described herein in relation to the preferred embodiment in FIG. 1 provides a method of operation that uses the typical mud passages already present in a typical rotary drill bit, including any watercourses in a "regular bit", or mud jets in a "jet bit", that allow mud to circulate during typical drilling operations for the second independent, and the distinctly separate, purpose of passing cement into the annulus between the casing and the well while cementing the drill string into place during one single pass into the earth.

The preferred embodiment of the invention further provides apparatus and methods of operation that result in the pumping of cement down the drill string, through the mud passages in the drill bit, and into the annulus between the formation and the drill string for the purpose of cementing the drill string and the drill bit into place during one single drilling pass into the formation.

The apparatus described in the preferred embodiment in FIG. 1 also provide a one-way cement valve and related devices installed near the drill bit of the drill string that allows the cement to set up efficiently while the drill string and drill bit are cemented into place during one single drilling pass into the formation.

Methods of operation of apparatus disclosed in FIG. 1 have been disclosed that use the typical mud passages already present in a typical rotary drill bit, including any watercourses in a "regular bit", or mud jets in a "jet bit", for the second independent purpose of passing cement into the annulus between the casing and the well while cementing the drill string in place. This is a crucial step that allows a "Typical Drilling Process" involving some 14 steps to be compressed into the "New Drilling Process" that involves only 7 separate steps as described in detail below. The New Drilling Process is now possible because of "Several Recent Changes in the Industry" also described in detail below.

Typical procedures used in the oil and gas industries to drill and complete wells are well documented. For example, such procedures are documented in the entire "Rotary Drilling Series" published by the Petroleum Extension Service of the University of Texas at Austin, Austin, Tex. that is included herein by reference in its entirety comprised of the following: Unit I—"The Rig and Its Maintenance" (12 Lessons); Unit II—"Normal Drilling Operations" (5 Lessons); Unit III—Nonroutine Rig Operations (4 Lessons); Unit IV—Man Management and Rig Management (1 Lesson); and Unit V—Offshore Technology (9 Lessons). All of the individual Glossaries of all of the above Lessons are explicitly included in the specification herein and any and all definitions in those Glossaries shall be considered explicitly referenced herein.

Additional procedures used in the oil and gas industries to drill and complete wells are well documented in the series entitled "Lessons in Well Servicing and Workover" published by the Petroleum Extension Service of the University of Texas at Austin, Austin, Tex. that is included herein by reference in its entirety comprised of all 12 Lessons. All of the individual Glossaries of all of the above Lessons are explicitly included in the specification herein and any and all definitions in those Glossaries shall be considered explicitly referenced herein.

With reference to typical practices in the oil and gas industries, a typical drilling process may therefore be described in the following.

Typical Drilling Process

From an historical perspective, completing oil and gas wells using rotary drilling techniques has in recent times comprised the following typical steps:

Step 1

With a pile driver or rotary rig, install any necessary conductor pipe on the surface for attachment of the blowout preventer and for mechanical support at the wellhead.

Step 2

Install and cement into place any surface casing necessary to prevent washouts and cave-ins near the surface, and to prevent the contamination of freshwater sands as directed by state and federal regulations.

Step 3

Choose the dimensions of the drill bit to result in the desired sized production well. Begin rotary drilling of the production well with a first drill bit. Simultaneously circulate drilling mud into the well while drilling. Drilling mud is circulated downhole to carry rock chips to the surface, to prevent blowouts, to prevent excessive mud loss into formation, to cool the bit, and to clean the bit. After the first bit wears out, pull the drill string out, change bits, lower the drill string into the well and continue drilling. It should be noted here that each "trip" of the drill bit typically requires many hours of rig time to accomplish the disassembly and reassembly of the drill string, pipe segment by pipe segment.

Step 4

Drill the production well using a succession of rotary drill bits attached to the drill string until the hole is drilled to its final depth.

Step 5

After the final depth is reached, pull out the drill string and its attached drill bit.

Step 6

Perform open-hole logging of the geological formations to determine the amount of oil and gas present. This typically involves measurements of the porosity of the rock, the electrical resistivity of the water present, the electrical resistivity of the rock, certain neutron measurements from within the open-hole, and the use of Archie's Equations. If no oil and gas is present from the analysis of such open-hole logs, an option can be chosen to cement the well shut. If commercial amounts of oil and gas are present, continue the following steps.

Step 7

Typically reassemble drill bit and drill string into the well to clean the well after open-hole logging.

Step 8

Pull out the drill string and its attached drill bit.

Step 9

Attach the casing shoe into the bottom male pipe threads of the first length of casing to be installed into the well. This casing shoe may or may not have a one-way valve ("casing shoe valve") installed in its interior to prevent fluids from back-flowing from the well into the casing string.

Step 10

Typically install the float collar onto the top female threads of the first length of casing to be installed into the well which has a one-way valve ("float collar valve") that allows the mud and cement to pass only one way down into the hole thereby preventing any fluids from back-flowing from the well into the casing string. Therefore, a typical installation has a casing shoe attached to the bottom and the float collar valve attached to the top portion of the first length of casing to be lowered into the well. Please refer to pages 28–31 of the book entitled "Casing and Cementing" Unit II Lesson 4, Second Edition, of the Rotary Drilling Series, Petroleum Extension Service, The University of Texas at Austin, Tex., 1982 (hereinafter defined as "Ref.1"). All of the individual definitions of words and phrases in the Glossary of Ref. 1 are explicitly included herein in their entirety.

Step 11

Assemble and lower the production casing into the well while back filling each section of casing with mud as it enters the well to overcome the buoyancy effects of the air filled casing (caused by the presence of the float collar valve), to help avoid sticking problems with the casing, and to prevent the possible collapse of the casing due to accumulated build-up of hydrostatic pressure.

Step 12

To "cure the cement under ambient hydrostatic conditions", typically execute a two-plug cementing procedure involving a first Bottom Wiper Plug before and a second Top Wiper Plug behind the cement that also minimizes cement contamination problems comprised of the following individual steps:

A. Introduce the Bottom Wiper Plug into the interior of the steel casing assembled in the well and pump down with cement that cleans the mud off the walls and separates the mud and cement (Ref. 1, pages 28–31).

B. Introduce the Top Wiper Plug into the interior of the steel casing assembled into the well and pump down with water under pump pressure thereby forcing the cement through the float collar valve and any other one-way valves present (Ref. 1, pages 28–31).

C. After the Bottom Wiper Plug and the Top Wiper Plug have seated in the float collar, release the pump pressure on the water column in the casing that results in the closing of the float collar valve which in turn prevents cement from backing up into the interior of the casing. The resulting interior pressure release on the inside of the casing upon closure of the float collar valve prevents distortions of the casing that might prevent a good cement seal (Ref. 1, page 30). In such circumstances, "the cement is cured under ambient hydrostatic conditions".

Step 13

Allow the cement to cure.

Step 14

Follow normal "final completion operations" that include installing the tubing with packers and perforating the casing near the producing zones. For a description of such normal final completion operations, please refer to the book entitled "Well Completion Methods", Well Servicing and Workover, Lesson 4, from the series entitled "Lessons in Well Servicing and Workover", Petroleum Extension Service, The University of Texas at Austin, Tex., 1971 (hereinafter defined as "Ref. 2"). All of the individual definitions of words and phrases in the Glossary of Ref. 2 are explicitly included herein in their entirety. Other methods of completing the well are described therein that shall, for the purposes of this application herein, also be called "final completion operations".

Several Recent Changes in the Industry

Several recent concurrent changes in the industry have made it possible to reduce the number of steps defined above. These changes include the following:

a. Until recently, drill bits typically wore out during drilling operations before the desired depth was reached by the production well. However, certain drill bits have recently been able to drill a hole without having to be changed. For example, please refer to the book entitled "The Bit", Unit I, Lesson 2, Third Edition, of the Rotary Drilling Series, The University of Texas at Austin, Tex., 1981 (hereinafter defined as "Ref. 3"). All of the individual definitions of words and phrases in the Glossary of Ref. 3 are explicitly included herein in their entirety. On page 1 of Ref. 3 it states: "For example, often only one bit is needed to make a hole in which the casing will be set." On page 12 of Ref. 3 it states in relation to tungsten carbide insert roller cone bits: "Bit runs as long as 300 hours have been achieved; in some instances, only one or two bits have been needed to drill a well to total depth." This is particularly so since the advent of the sealed bearing tri-cone bit designs appeared in 1959 (Ref. 3, page 7) having tungsten carbide inserts (Ref. 3, page 12). Therefore, it is now practical to talk about drill bits lasting long enough for drilling a well during one pass into the formation, or "one pass drilling".

b. Until recently, it has been impossible or impractical to obtain sufficient geophysical information to determine the presence or absence of oil and gas from inside steel pipes in wells. Heretofore, either standard open-hole logging tools or Measurement-While-Drilling ("MWD") tools were used in the open-hole to obtain such information. Therefore, the industry has historically used various open-hole tools to measure formation characteristics. However, it has recently become possible to measure the various geophysical quantities listed in Step 6 above from inside steel pipes such as drill strings and casing strings. For example, please refer to the book entitled "Cased Hole Log Interpretation Principles/Applications", Schlumberger Educational Services, Houston, Tex., 1989. Please also refer to the article entitled "Electrical Logging: State-of-the-Art", by Robert E. Maute, The Log Analyst, May-June 1992, pages 206–227.

Because drill bits typically wore out during drilling operations until recently, different types of metal pipes have historically evolved which are attached to drilling bits, which, when assembled, are called "drill strings". Those drill strings are different than typical "casing strings" run into the well. Because it was historically absolutely necessary to do open-hole logging to determine the presence or absence of oil and gas, the fact that different types of pipes were used in "drill strings" and "casing strings" was of little consequence to the economics of completing wells. However, it is possible to choose the "drill string" to be acceptable for a second use, namely as the "casing string" that is to be installed after drilling has been completed.

New Drilling Process

Therefore, the preferred embodiments of the invention herein reduce and simplify the above 14 steps as follows:

Repeat Steps 1–2 above.

Steps 3–5 (Revised)

Choose the drill bit so that the entire production well can be drilled to its final depth using only one single drill bit.

Choose the dimensions of the drill bit for desired size of the production well. If the cement is to be cured under ambient hydrostatic conditions, attach the drill bit to the bottom female threads of the Latching Subassembly ("Latching Sub"). Choose the material of the drill string from pipe material that can also be used as the casing string. Attach the first section of drill pipe to the top female threads of the Latching Sub. Rotary drill the production well to its final depth during "one pass drilling" into the well. While drilling, simultaneously circulate drilling mud to carry the rock chips to the surface, to prevent blowouts, to prevent excessive mud loss into formation, to cool the bit, and to clean the bit.

Step 6 (Revised)

After the final depth of the production well is reached, perform logging of the geological formations to determine the amount of oil and gas present from inside the drill pipe of the drill string. This typically involves measurements from inside the drill string of the necessary geophysical quantities as summarized in Item "b." of "Several Recent Changes in the Industry". If such logs obtained from inside the drill string show that no oil or gas is present, then the drill string can be pulled out of the well and the well filled in with cement. If commercial amounts of oil and gas are present, continue the following steps.

Steps 7–11 (Revised)

If the cement is to be cured under ambient hydrostatic conditions, pump down a Latching Float Collar Valve Assembly with mud until it latches into place in the notches provided in the Latching Sub located above the drill bit.

Steps 12–13 (Revised)

To "cure the cement under ambient hydrostatic conditions", typically execute a two-plug cementing procedure involving a first Bottom Wiper Plug before and a second Top Wiper Plug behind the cement that also minimizes cement contamination comprised of the following individual steps:

A. Introduce the Bottom Wiper Plug into the interior of the drill string assembled in the well and pump down with cement that cleans the mud off the walls and separates the mud and cement.

B. Introduce the Top Wiper Plug into the interior of the drill string assembled into the well and pump down with water thereby forcing the cement through any Float Collar Valve Assembly present and through the watercourses in "a regular bit" or through the mud nozzles of a "jet bit" or through any other mud passages in, the drill bit into the annulus between the drill string and the formation.

C. After the Bottom Wiper Plug and Top Wiper Plug have seated in the Latching Float Collar Valve Assembly, release the pressure on the interior of the drill string that results in the closing of the float collar which in turn prevents cement from backing up in the drill string. The resulting pressure release upon closure of the float collar prevents distortions of the drill string that might prevent a good cement seal as described earlier. I.e., "the cement is cured under ambient hydrostatic conditions".

Repeat Step 14 above.

Therefore, the "New Drilling Process" has only 7 distinct steps instead of the 14 steps in the "Typical Drilling Process". The "New Drilling Process", consequently has fewer steps, is easier to implement, and will be less expensive.

The preferred embodiment of the invention disclosed in FIG. 1 requires a Latching Subassembly and a Latching Float Collar Valve Assembly. The advantage of this approach is that the Float 32 of the Latching Float Collar Valve Assembly and the Float Seating Surface 34 in FIG. 1 are installed at the end of the drilling process and will not be worn due to mud passage during normal drilling operations.

Another preferred embodiment of the invention provides a float and float collar valve assembly permanently installed within the Latching Subassembly at the beginning of the drilling operations. However, such a preferred embodiment has the disadvantage that drilling mud passing by the float and the float collar valve assembly during normal drilling operations will tend to wear on the mutually sealing surfaces.

The drill bit described in FIG. 1 is a milled steel toothed roller cone bit. However, any rotary bit can be used with the invention. A tungsten carbide insert roller cone bit can be used. Any type of diamond bit or drag bit can be used. The invention may be used with any drill bit described in Ref. 3 above that possesses mud passages, waterpassages, or passages for gas. Any type of rotary drill bit can be used possessing such passageways. Similarly, any type of bit whatsoever that utilizes any fluid or gas that passes through passageways in the bit can be used whether or not the bit rotates.

While the above description contains many specificities, these should not be construed as limitations on the scope of the invention, but rather as exemplification of preferred embodiments thereto. As have been briefly described, there are many possible variations. Accordingly, the scope of the invention should be determined not only by the embodiments illustrated, but by the appended claims and their legal equivalents.

The invention claimed is:

1. A method for forming a wellbore, comprising:
providing a drill string having a casing portion;
drilling the wellbore using the drill string;
locating the casing portion within the wellbore;
pumping a one-way valve down the drill string; and
placing a physically alterable bonding material in an annulus formed between the casing portion and the wellbore.

2. The method of claim 1, wherein placing the physically alterable bonding material in the annulus comprises flowing the bonding material through an earth removal member connected to the drill string.

3. The method of claim 2, further comprising circulating drilling fluid through the earth removal member while locating the casing portion within the wellbore.

4. The method of claim 1, further comprising establishing a hydrostatic pressure condition in the wellbore and allowing the bonding material to physically alter under the hydrostatic pressure condition.

5. The method of claim 4, wherein the bonding material is allowed to physically alter by reducing fluid pressure within the drill string.

6. The method of claim 1, further comprising connecting the one-way valve to the casing portion.

7. The method of claim 1, further comprising connecting an earth removal member to a lower end of the casing portion.

8. The method of claim 7, further comprising positioning the one-way valve above the earth removal member.

9. The method of claim 1, further comprising disposing a first wiper plug in front of the bonding material and a second wiper plug behind the bonding material.

10. The method of claim 9, further comprising landing the first wiper plug on the one-way valve.

11. The method of claim 1, further comprising stabilizing the drill string while drilling the wellbore.

12. The method of claim 1, further comprising maintaining the casing portion in a substantially centralized position in relation to a diameter of the wellbore after locating the casing portion within the wellbore.

13. The method of claim 1, wherein the physically alterable bonding material is cement.

14. The method of claim 1, wherein drilling the wellbore using the drill string comprises drilling with an earth removal member operatively connected to the drill string.

15. The method of claim 14, wherein the earth removal member is connected to the casing portion.

16. The method of claim 15, wherein the earth removal member is connected to a lower end of the casing portion.

17. The method of claim 1, further comprising measuring a geophysical parameter.

18. The method of claim 17, further comprising disposing a first wiper plug in front of the bonding material and a second wiper plug behind the bonding material.

19. The method of claim 18, further comprising landing the first wiper plug on the one-way valve.

20. The method of claim 19, further comprising establishing a hydrostatic pressure condition in the wellbore and allowing the bonding material to physically alter under the hydrostatic pressure condition.

21. The method of claim 20, wherein the bonding material is allowed to physically alter by reducing fluid pressure within the drill string.

22. A method for forming a wellbore, comprising:

providing a drill string having a casing portion;

drilling the wellbore using the drill string;

pumping a valve assembly down the drill string; and locating the valve assembly in the casing portion.

23. The method of claim 22, wherein locating the valve assembly comprises latching the valve assembly to the casing portion.

24. The method of claim 22, further comprising attaching a drill bit at a lower end of the casing portion.

25. The method of claim 22, further comprising selectively blocking fluid flow through the casing portion.

26. The method of claim 25, wherein selectively blocking fluid flow through the casing portion comprises introducing a wiper plug into the casing portion.

27. The method of claim 22, wherein the valve assembly is pumped down the drill string using a drilling fluid.

28. The method of claim 27, further comprising introducing cement behind the drilling fluid.

29. The method of claim 28, further comprising positioning a wiper plug between the drilling fluid and cement.

30. The method of claim 22, wherein the valve assembly comprises a one-way valve.

31. The method of claim 22, further comprising selectively altering a trajectory of the wellbore.

* * * * *

UNITED STATES PATENT AND TRADEMARK OFFICE

CERTIFICATE OF CORRECTION

PATENT NO. : 7,165,634 B2
APPLICATION NO. : 10/678738
DATED : January 23, 2007
INVENTOR(S) : William Banning Vail, III It is certified that error appears in the above-identified patent and that said Letters Patent is hereby corrected as shown below:

On the Title Page, Item -56-
Page 6, Line 14, please delete "2002/0071922 A1 6/2002 Bailey et al";

On the Title Page, Item -56-
Page 6, Line 26, please delete "2003/0029841 A1 2/2003 Meehan".

Signed and Sealed this

Eighth Day of July, 2008

JON W. DUDAS
*Director of the United States Patent and Trademark Office*